US008915224B2

(12) United States Patent
Langewisch et al.

(10) Patent No.: US 8,915,224 B2
(45) Date of Patent: Dec. 23, 2014

(54) ROCKER SHAFT SHIM

(75) Inventors: Edwin H. Langewisch, Dunlap, IL (US); Lloyd E. Thompson, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 775 days.

(21) Appl. No.: 12/972,445

(22) Filed: Dec. 18, 2010

(65) Prior Publication Data

US 2012/0152196 A1 Jun. 21, 2012

(51) Int. Cl.
*F01L 1/18* (2006.01)

(52) U.S. Cl.
CPC ..... *F01L 1/18* (2013.01)
USPC ..... 123/90.39

(58) Field of Classification Search
USPC ..... 123/90.1, 90.16, 90.39–90.47, 90.36, 123/90.38, 193.5; 384/276, 288, 289
See application file for complete search history.

(56) References Cited

U.S. PATENT DOCUMENTS

| | | | | |
|---|---|---|---|---|
| 3,396,711 A | | 8/1968 | Fangman et al. | |
| 4,655,177 A | | 4/1987 | Wells et al. | |
| 5,970,932 A | * | 10/1999 | Richardson et al. | 123/90.36 |
| 6,086,327 A | * | 7/2000 | Mack et al. | 415/160 |
| 6,210,503 B1 | * | 4/2001 | Naylor et al. | 148/680 |
| 6,230,676 B1 | | 5/2001 | Pryba et al. | |
| 6,413,052 B1 | | 7/2002 | Corley | |
| 6,516,766 B2 | * | 2/2003 | Kotani et al. | 123/90.39 |
| 6,910,452 B2 | * | 6/2005 | Motohashi | 123/90.44 |
| 8,220,423 B2 | * | 7/2012 | Abe et al. | 123/90.1 |
| 2009/0173301 A1 | | 7/2009 | Lugosi et al. | |

FOREIGN PATENT DOCUMENTS

| | | |
|---|---|---|
| KR | 20-1998-0068302 U | 12/1998 |
| KR | 10-2009-0073047 A | 7/2009 |

OTHER PUBLICATIONS

Lameco Group Laminated Shims, web site, Nov. 24, 2010, http://www.lamecogroup.com/en/index.html.

* cited by examiner

*Primary Examiner* — Thomas Denion
*Assistant Examiner* — Daniel Bernstein
(74) *Attorney, Agent, or Firm* — Finnegan, Henderson, Farabow, Garrett & Dunner LLP

(57) ABSTRACT

The present disclosure relates to shims 10, 24 adapted for placement between a rocker shaft 42 and rocker shaft mounts 62, 64. The rocker shaft mounts 62, 64 project from the cylinder head 60 of an internal combustion engine. The shims 10, 24 are composed of a copper alloy, preferably bronze.

19 Claims, 3 Drawing Sheets

ROCKER SHAFT SHIM

TECHNICAL FIELD

The present disclosure relates to shims, more particularly the present disclosure relates to shims for use in mounting rocker shafts to rocker shaft mounts and a method of reducing fretting wear in engines.

BACKGROUND

Fretting is a type of wear caused by two contact surfaces undergoing relative motion under load. The relative motion is often not intended and may be caused by vibration or part deflection under load. The ASM Handbook on Fatigue and Fracture defines fretting as "a special wear process that occurs at the contact area between two materials under load and subject to minute relative motion by vibration or some other force."

One example of this is rocker shafts in internal combustion engines. Rocker shafts are used to mount rockers. Rockers are activated by camshafts and control valve and injector motion. They oscillate on rocker shafts. The rocker shafts are mounted on rocker shaft mounts which are mounted on the cylinder head of an internal combustion engine.

Fretting can be a problem on the contact surfaces of rocker shaft and rocker shaft mounts, because of rocker shaft deflections.

Prior art solutions have been proposed that minimize movement by providing a close fit between the rocker shaft and rocker shaft mount. For example, U.S. Pat. No. 6,230,676B1 describes that the semi-circular recess of a rocker shaft mount should be dimensioned just slightly larger than the rocker shaft to permit assembly but prevent unwanted looseness or play.

SUMMARY OF THE INVENTION

In one aspect, the present invention is directed to a shim for use in mounting a rocker shaft to a rocker shaft mount. The shim comprises a body having a first surface portion adapted to contact a rocker shaft in use and a second surface portion adapted to contact a rocker shaft mount in use, wherein at least one of said first surface portion and said second surface portion is composed of a copper alloy.

In another aspect, the present invention is directed to an engine comprising a cylinder block, a cylinder head and a rocker shaft. The cylinder head includes a rocker shaft mount, and a shim, the shim comprising a body having a first surface portion contacting the rocker shaft and a second surface portion contacting the rocker shaft mount, wherein the shim is composed of a shim material with a lower modulus of elasticity than the material of the rocker shaft and rocker shaft mount.

In another aspect, the present invention is directed to a method of reducing fretting wear in an engine. The engine comprises a cylinder block, a cylinder head, and a rocker shaft, with the cylinder head including a rocker shaft mount. The method includes the step of mounting a shim composed of a shim material with a lower modulus of elasticity than the material of the rocker shaft and rocker shaft mount.

BRIEF DESCRIPTION OF THE DRAWINGS

The accompanying drawings illustrate presently preferred exemplary embodiments of the disclosure, and together with the general description given above and the detailed description of the preferred embodiments given below, serve to explain, by way of example, the principles of the disclosure.

DETAILED DESCRIPTION

Figure 1:
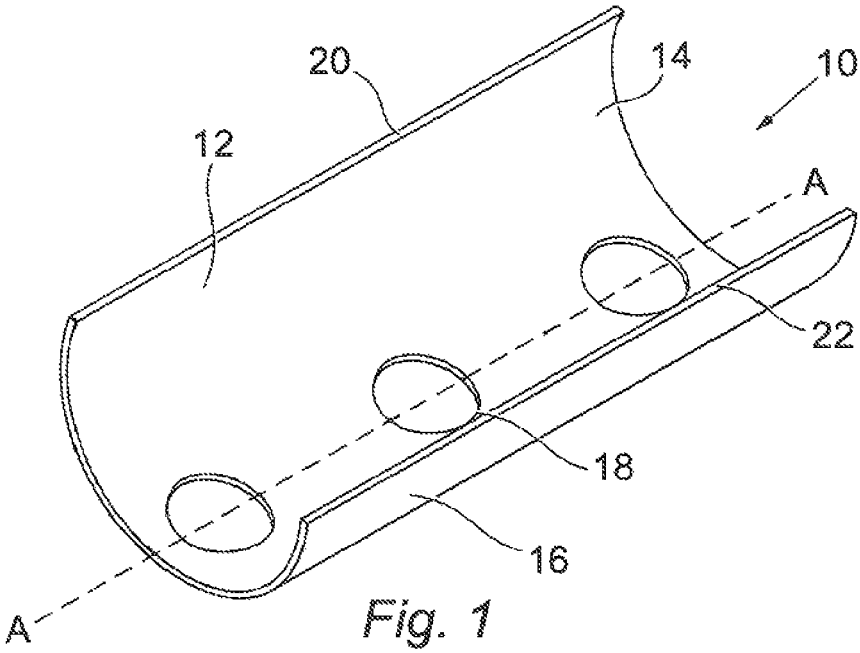
FIG. 1 is a perspective view of a shim according to an exemplary embodiment of the present disclosure.

A shim 10 is shown in FIG. 1. The shim 10 comprises a body 12, a first surface 14 and a second surface 16. The shim 10 is a mid-shaft shim 10. The mid-shaft shim 10 is arcuately shaped. The body 12, first surface 14 and second surface 16 are also arcuately shaped. Three apertures 18 pass through the body 12 of the mid-shaft shim 10. The three apertures 18 are orientated along a longitudinal axis A-A of the mid-shaft shim 10 approximately halfway between a first longitudinal edge 20 and a second longitudinal edge 22 of the mid-shaft shim 10. The mid-shaft shim 10 is composed from a copper alloy. The copper alloy is a bronze. The copper alloy contains manganese and silicon. The mid-shaft shim 10 is approximately 1 mm thick. The distance between the first surface 14 and the second surface 16 is therefore approximately 1 mm. In other embodiments, however, the mid-shaft shim may be thicker or thinner than approximately 1 mm. For example, in other embodiments, the mid-shaft shim may be in the range of approximately 0.5 mm to approximately 1.5 mm thick.

Figure 2:
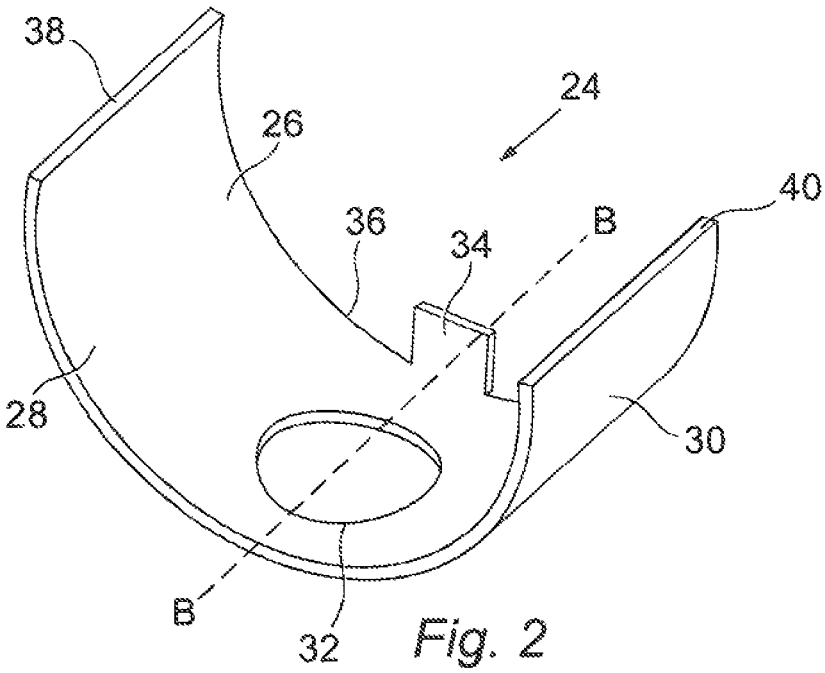
FIG. 2 is a perspective view of a further shim according to an exemplary embodiment of the present disclosure.

A second shim 24 is shown in FIG. 2. The second shim 24 comprises a body 26, a first surface 28 and a second surface 30. The second shim 24 is an end-shaft shim 24. An aperture 32 pass through the body 26 of the end-shaft shim 24. A tab 34 projects from a first edge 36 of the body 26 of the end-shaft shim 24. The tab 34 and aperture 32 are orientated along the longitudinal axis B-B of the end-shaft shim 24 approximately halfway between a first longitudinal edge 38 and a second longitudinal edge 40 of the end-shaft shim 24. The end-shaft shim 24 is composed from a copper alloy. The copper alloy is a bronze. The copper alloy contains manganese and silicon. The end-shaft shim 24 is approximately 1 mm thick. The distance between the first surface 28 and the second surface 30 is therefore approximately 1 mm. In other embodiments, however, the end-shaft shim may be thicker or thinner than approximately 1 mm. For example, in other embodiments, the end-shaft shim may be in the range of approximately 0.5 mm to approximately 1.5 mm thick.

Figure 3:
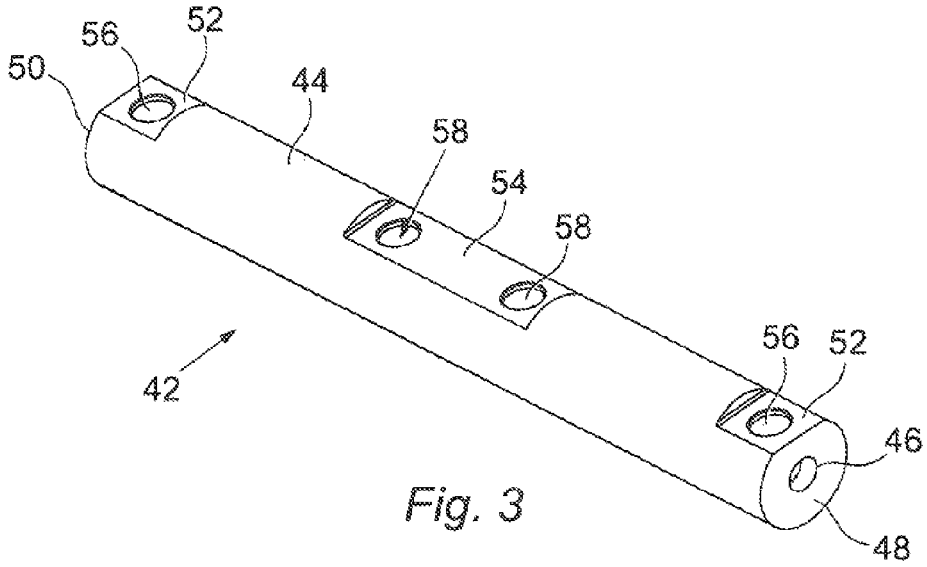
FIG. 3 is a perspective view of a rocker shaft for use with the shims of FIGS. 1 & 2.

A rocker shaft 42 is shown in FIG. 3. The rocker shaft 42 comprises a rocker shaft body 44. The rocker shaft body 44 is substantially cylindrical. A rocker shaft central bore 46 passes through the centre of the rocker shaft body 44. A first shaft face 48 and second shaft face 50 are provided on either end of the rocker shaft body 44.

Two end-shaft flat portions 52 are provided on the circumference of the rocker shaft 42 adjacent the first shaft face 48 and second shaft face 50. The end-shaft flat portions 52 are squared surfaces around the otherwise circular cross-section of the rocker shaft 42.

A mid-shaft flat portion 54 is provided on the circumference of the rocker shaft 42 approximately half-way along the length of the rocker shaft 42. The mid-shaft flat portion 54 is a squared surface around the otherwise circular cross-section of the rocker shaft 42.

The end-shaft flat portions 52 and mid-shaft flat portion 54 share a common plane.

One end-shaft flat portion aperture 56 is provided on each end-shaft flat portion 52, and is perpendicular to the rocker shaft central bore 46 passing radially through the rocker shaft body 44.

Two mid-shaft flat portion apertures 58 are provided on the mid-shaft flat portion 54, and are perpendicular to the rocker shaft central bore 46 passing radially through the rocker shaft body 44.

Figure 5:
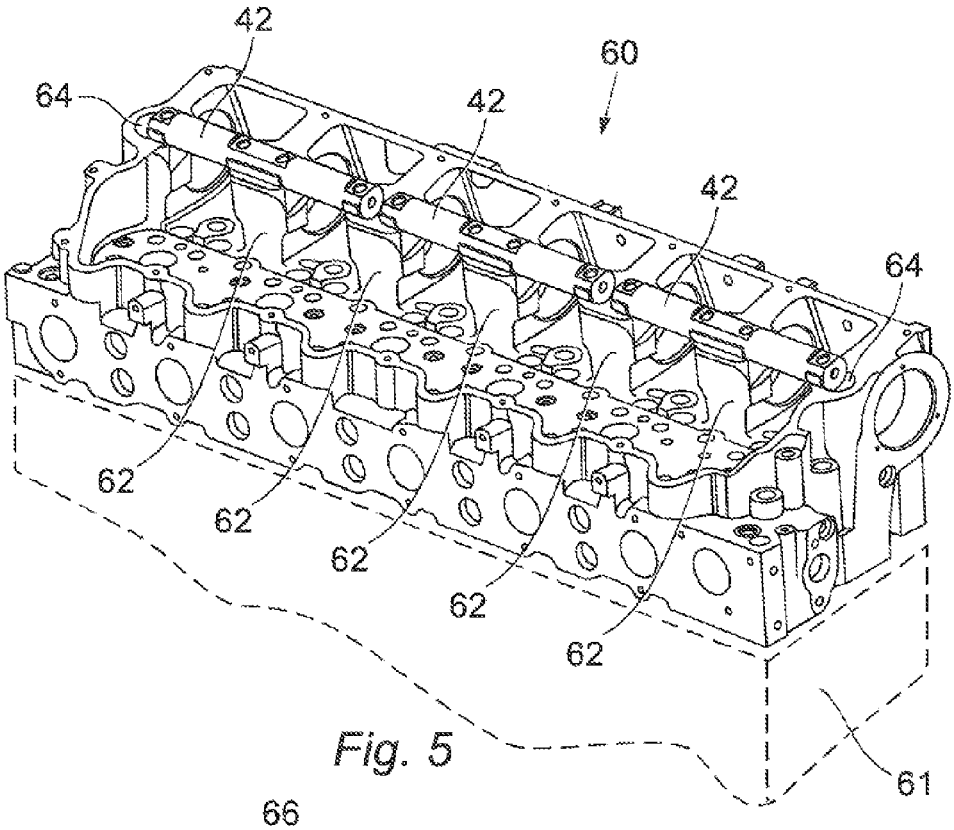
FIG. 5 is a perspective view of cylinder head of an engine according to an exemplary embodiment of the present disclosure.
Figure 6:
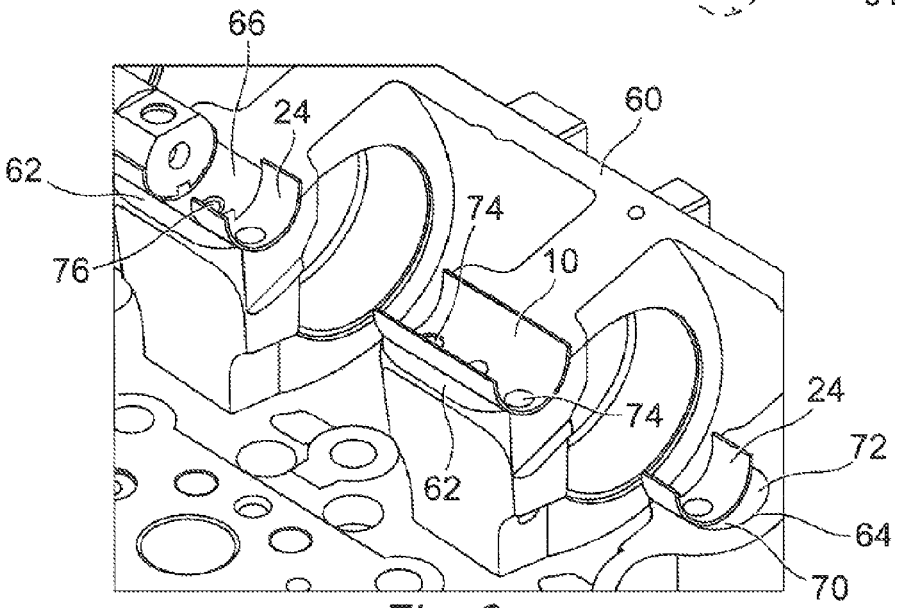
FIG. 6 is a detailed perspective view of the rocker shaft shims of FIGS. 1 & 2 in situ on the cylinder head of FIG. 5.

A cylinder head 60 is shown in FIG. 5. Five main rocker shaft mounts 62 project from the cylinder head 60. Two perimeter rocker shaft mounts 64 also project from the cylinder head 60. The main rocker shaft mounts 62 and perimeter rocker shaft mounts 64 project in a common plane. A main mount cylindrical mounting surface 66 is provided on each main rocker shaft mount 62. A perimeter mount mounting surface 68 is provided on each perimeter rocker shaft mounts 64. The perimeter mount mounting surface 68 is formed from a cylindrical perimeter mount mounting surface portion 70 joined to a hemispherical perimeter mount mounting surface portion 72.

Threaded mounting bores 74 are provided on the main mount cylindrical mounting surface 66 and the perimeter mount mounting surface 68. A lubricant bore 76 is provided on the main mount cylindrical mounting surface 66, between two threaded mounting bores 74, one located longitudinally either side of the lubricant bore 76.

Figure 4:
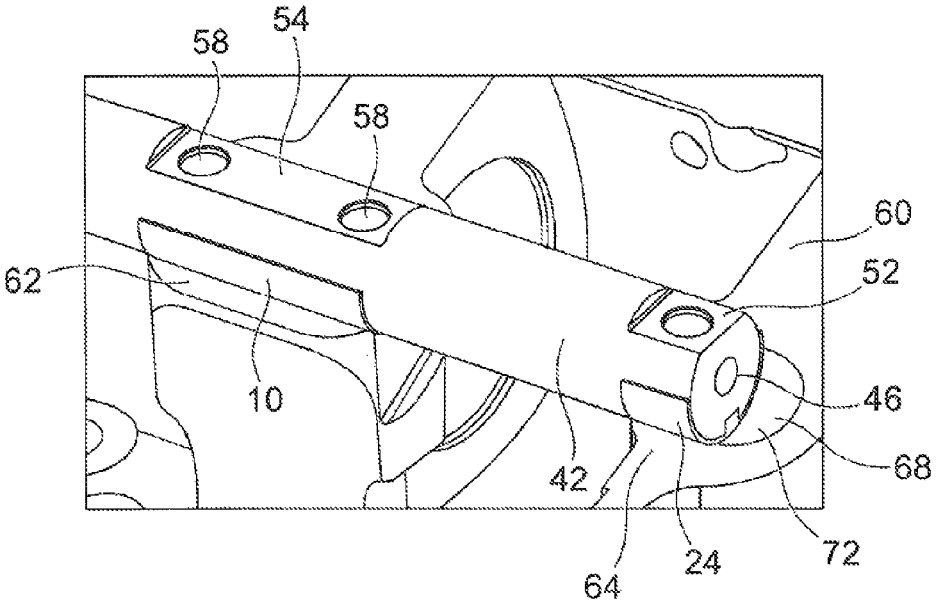
FIG. 4 is perspective view of the rocker shaft of FIG. 3 in situ on a cylinder head showing placement of the shims of FIGS. 1 & 2.

FIG. 4 shows detail of the rocker shaft 42 mounted onto the cylinder head 60 using the mid-shaft shim 10 and the end-shaft shim 24.

The mid-shaft shim 10 locates around the outer surface of the rocker shaft 42. The mid-shaft shim 10 is mounted around the portion of the outer surface of the rocker shaft 42 longitudinally adjacent the mid-shaft flat portion 54. The mid-shaft shim 10 is mounted circumferentially opposite the mid-shaft flat portion 54.

The end-shaft shim 24 locates around the outer surface of the rocker shaft 42. The end-shaft shim 24 is mounted around the portion of the outer surface of the rocker shaft 42 longitudinally adjacent the end-shaft flat portion 52. The end-shaft shim 24 is mounted circumferentially opposite the end-shaft flat portion 52.

Neither mid-shaft shim 10 nor end-shaft shim 24 cover the mid-shaft flat portion 54 or the end-shaft flat portion 52.

The rocker shaft 42 is then mounted upon the main rocker shaft mounts 62 and the perimeter rocker shaft mounts 64. The mid-shaft shim 10 is mounted into the main mount cylindrical mounting surface 66 of a main rocker shaft mount 62. The mid-shaft shim 10 is therefore sandwiched between the rocker shaft 42 and the main rocker shaft mount 62.

The end-shaft shim 24 adjacent the first shaft face 48 is mounted into the perimeter mount mounting surface 68 of a perimeter rocker shaft mount 64. The end-shaft shim 24 adjacent the second shaft face 50 is mounted into the main mount cylindrical mounting surface 66 of a main rocker shaft mount 62.

Both of the shims (mid-shaft shim 10 and end-shaft shim 24) may be sized such that they clasp the rocker shaft 42. For example, in the depicted embodiment of the mid-shaft shim 10, the first longitudinal edge 20 and the second longitudinal edge 22 are, in a free state, spaced apart a distance that is less than the diameter of the rocker shaft 42. Thus, when being mounted onto the rocker shaft 42, the first longitudinal edge 20 and the second longitudinal edge 22 flex apart at the widest part of the rocker shaft 42. The resilient nature of the shim material results in a gripping force onto the rocker shaft 42 to retain the mid-shaft shim 10 on the shaft. In the depicted embodiment, the mid-shaft shim 10 and the end-shaft shim 24 extend around the outer surface of the rocker shaft 42 greater than half of the circumference of the shaft. In other embodiments, the mid-shaft shim 10 and the end-shaft shim 24 may not be configured to clasp the rocker shaft 42 and may not extend around the outer surface of the rocker shaft 42 greater than half of the circumference of the shaft.

The tab 34 of the end-shaft shim 24 provides an orientation aid for mounting the end-shaft shim 24.

Bolts (not shown) or other suitable mechanical fasteners are used to secure the rocker shaft 42, mid-shaft shim 10 and end-shaft shims 24 to the cylinder head 60 via the main rocker shaft mounts 62 and the perimeter rocker shaft mounts 64. The bolts (not shown) pass through the end-shaft flat portion apertures 56 and mid-shaft flat portion apertures 58 of the rocker shaft 42, through the apertures 18 of the mid-shaft shim 10 and the apertures 32 of the end-shaft shim 24 and into the threaded mounting bores 74. Washers (not shown) may be provided between the bolt head and the mid-shaft flat portion 54 and/or the end-shaft flat portion 52 to mitigate wear or potential damage.

The cylinder head 60 may then be mounted upon a cylinder block 61 shown schematically in FIG. 5.

INDUSTRIAL APPLICABILITY

During engine operation, undesirable and unintended relative movement of the rocker shaft 42 with respect to the main rocker shaft mounts 62 and the perimeter rocker shaft mounts 64 may occur. Undesirable relative movement may be caused by, for example, vibration from the reciprocation of the various engine parts or part deflection under load, such as the deflection of the rocker shaft due to injector actuation loading. This relative motion may cause fretting of the rocker shaft 42, the mounts or both.

The shims (both mid-shaft shim 10 and end-shaft shim 24) will provide two surfaces for relative slip to occur over. The first surfaces 14, 28 will contact the mounting surfaces 66, 68 and the second surfaces 16, 30 will contact the rocker shaft 42.

The low elastic modulus copper alloy material, in this embodiment bronze, reduces the contact pressure since the ability of the material to deflect allows a larger contact surface to develop between the shims (both mid-shaft shim 10 and end-shaft shim 24), the mounting surfaces 66, 68 and the rocker shaft 42.

The bronze layer provided by the shims 10, 24 also disperses the contact pressure developed at the interface between the mounting surfaces 66, 68 and the rocker shaft 42 such that the mounting surfaces 66, 68 experience less contact pressure than the rocker shaft 42.

The bronze contains silicon and manganese that offer improved surface lubrication to further reduce the shear stress at the interface.

Suitable engine lubricant (not shown) may be pumped through the cylinder head 60, through the lubricant bore 76, through the mid-shaft shim 10 and into the rocker shaft central bore 46. This provides lubrication to the various components.

The shims (both mid-shaft shim 10 and end-shaft shim 24) serve as sacrificial wear parts that can be replaced instead of having to replace the rocker shaft 42 or cylinder head 60 if they were subject to fretting wear.

A method is also provided for reducing fretting wear by fitting shims composed of a shim material with a lower modulus of elasticity than the material of the rocker shaft 42 and rocker shaft mounts 62, 64.

It will be apparent to those skilled in the art that various modifications and variations can be made to the apparatus and method. Other embodiments will be apparent to those skilled in the art from consideration of the specification and practice of the disclosed apparatus and method. It is intended that the specification and examples be considered as exemplary only, with a true scope being indicated by the following claims and their equivalents.

For example, although described with particular reference to copper alloys, and in particular bronze containing silicon and manganese alloying elements, different elements, substances or alloys may be used. These may include other copper alloys such as, but not limited to, brass. Furthermore, materials which have the desired property of having a lower elastic modulus than the material from which the cylinder head 60 is made may be considered, such as, for example, mild steel.

The invention claimed is:

1. A shim for use in mounting a rocker shaft to a rocker shaft mount, the shim comprising a body having a first surface portion adapted to contact a rocker shaft in use and a second surface portion adapted to contact a rocker shaft mount in use, wherein at least one of said first surface portion and said second surface portion is composed of a copper alloy, and wherein the shim has a first longitudinal edge and a second longitudinal edge spaced apart a distance that is less than a diameter of the rocker shaft, and wherein the shim has an axial length, the first and second longitudinal edges being flat and extending substantially the axial length of the shim.

2. A shim according to claim 1 wherein both surface portions are composed of a copper alloy.

3. A shim according to claim 1 wherein the body is also composed of a copper alloy.

4. A shim according to claim 1 wherein the copper alloy is bronze.

5. A shim according to claim 1 wherein the copper alloy includes silicon.

6. A shim according to claim 1 wherein the copper alloy includes manganese.

7. A shim according to claim 1 wherein the shim is arcuate shaped, with the first surface portion being an interior surface and the second surface portion being an exterior surface, and wherein the dimensions of the arcuate shape of the shim are adapted such that in use the shim clasps a rocker shaft.

8. A shim according to claim 1 including a shim orientating marker.

9. A shim according to claim 8 wherein the shim orientating marker is a tab.

10. An engine comprising a cylinder block, a cylinder head, a rocker shaft, the cylinder head including a rocker shaft mount, and a shim according to claim 1 mounted between the rocker shaft mount and the rocker shaft.

11. A shim according to claim 1 wherein the body extends around greater than half of the circumference of the rocker shaft in use.

12. A shim according to claim 1 wherein at least one aperture passes through the body of the shim, the at least one aperture being oriented along a longitudinal axis approximately halfway between the first and second longitudinal edges.

13. A shim for use in mounting a rocker shaft to a rocker shaft mount, the shim comprising an arcuate shaped body having a first surface portion adapted to contact the rocker shaft in use and a second surface portion adapted to contact the rocker shaft mount in use, wherein the dimensions of the arcuate shape of the shim are adapted such that in use the shim clasps the rocker shaft, and wherein the shim has a first longitudinal edge and a second longitudinal edge spaced apart a distance that is less than a diameter of the rocker shaft, and wherein the shim has an axial length, the first and second longitudinal edges being flat and extending substantially the axial length of the shim.

14. A shim according to claim 13 wherein the body extends around greater than half of the circumference of the rocker shaft in use.

15. A shim according to claim 13 wherein at least one of said first surface portion and said second surface portion is composed of a copper alloy.

16. An engine comprising a cylinder block, a cylinder head, a rocker shaft, the cylinder head including a rocker shaft mount, and a shim, the shim comprising a body having a first surface portion contacting the rocker shaft and a second surface portion contacting the rocker shaft mount, wherein the shim is composed of a shim material with a lower modulus of elasticity than the material of the rocker shaft and rocker shaft mount, and wherein the body is arcuate shaped and the dimensions of the body are adapted such that in use the shim clasps the rocker shaft, and wherein the shim has a first longitudinal edge and a second longitudinal edge spaced apart a distance that is less than a diameter of the rocker shaft, and wherein the shim has an axial length, the first and second longitudinal edges being flat and extending substantially the axial length of the shim.

17. An engine according to claim 16 wherein the shim material is a copper alloy.

18. A method of reducing fretting wear in an engine, the engine comprising a cylinder block, a cylinder head, a rocker shaft, with the cylinder head including a rocker shaft mount, including the steps of mounting a shim composed of a shim material with a lower modulus of elasticity than the material of the rocker shaft and rocker shaft mount, wherein the shim has a body that is arcuate shaped and the dimensions of the body are adapted such that in use the shim clasps the rocker shaft, and wherein the shim has a first longitudinal edge and a second longitudinal edge spaced apart a distance that is less than a diameter of the rocker shaft, and wherein the shim has an axial length, the first and second longitudinal edges being flat and extending substantially the axial length of the shim.

19. A method according to claim 18 wherein the shim material is a copper alloy.

* * * * *